US011839276B2

(12) United States Patent
Elggren

(10) Patent No.: US 11,839,276 B2
(45) Date of Patent: Dec. 12, 2023

(54) SYSTEM AND METHOD FOR CARD MANAGEMENT

(71) Applicant: Jacob C Elggren, Mesa, AZ (US)

(72) Inventor: Jacob C Elggren, Mesa, AZ (US)

(73) Assignee: Andar Products, LLC, Chandler, AZ (US)

( * ) Notice: Subject to any disclaimer, the term of this patent is extended or adjusted under 35 U.S.C. 154(b) by 503 days.

(21) Appl. No.: 16/894,777

(22) Filed: Jun. 6, 2020

(65) Prior Publication Data

US 2021/0378375 A1 Dec. 9, 2021

(51) Int. Cl.
*A45C 11/18* (2006.01)
*A45C 1/06* (2006.01)

(52) U.S. Cl.
CPC ..... *A45C 11/182* (2013.01); *A45C 1/06* (2013.01); *A45C 2001/065* (2013.01)

(58) Field of Classification Search
CPC .... A45C 11/182; A45C 2001/065; A45C 1/06
See application file for complete search history.

(56) References Cited

U.S. PATENT DOCUMENTS

2020/0178657 A1* 6/2020 Van Geer ..... A45C 11/182

FOREIGN PATENT DOCUMENTS

WO WO-2010137975 A2 * 12/2010 ..... A45C 11/182
WO WO-2014098580 A1 * 6/2014 ..... A45C 11/18

* cited by examiner

*Primary Examiner* — Sue A Weaver
(74) *Attorney, Agent, or Firm* — Gavvel LLC

(57) ABSTRACT

A card management system is used to store one or more cards in a secure and flexible manner, allowing for selective extraction and retention of one or more cards from the card management system. The card management system comprises a housing containing a stack of cards, such as credit cards and the like with at least one card opening for locating and removing cards by rotating a spring-loaded thumb wheel. When rotational pressure is applied, the thumb wheel rotates translating the rotational movement into linear movement, thereby causing a card carrier to partially extend one or more cards through a card opening in the housing. With the cards now being partially exposed, one or more cards can be selected for use. When the pressure on the thumb wheel is released, the card carrier moves the card carrier retracts back into the housing by the spring tension.

11 Claims, 4 Drawing Sheets

SYSTEM AND METHOD FOR CARD MANAGEMENT

BACKGROUND OF THE INVENTION

1. Technical Field

The present specification relates generally to organizational devices and more specifically to a system and method for storing and retrieving cards such as credit cards.

2. Background

The use of small rigid cards (e.g., credit cards, debit cards, loyalty cards, etc.) is well known. Over time, it is not uncommon for people to accumulate a number of cards from multiple vendors. Many people carry various cards in their wallet or purse in order to have the cards with them at all times and the use of various types of purses and wallets to store and manage cards is also well known.

While presently deployed card carrying products are useful, most of the known devices suffer from one or more deficiencies that can be problematic. For example, most wallets have a limited number of storage locations for holding cards. Additionally, with the cards stored in fewer locations, it is common to shuffle through a series of cards in order to locate the desired card from the plurality of cards.

Similarly, with a purse, the purse will contain a multitude of items, including a wallet. As with a person carrying a wallet in a pocket, the wallet must be retrieved and the hunt for a specific card is on. Further, many of the products are utilitarian and not stylish or attractive to the average user and consumers are more generally drawn to style and function. Accordingly, without significant improvements in the state of the art, managing credit cards and the like will continue to be suboptimal.

BRIEF SUMMARY OF THE INVENTION

Aspects disclosed herein relates to a card management system for storing one or more cards in a secure and flexible manner, allowing for selective extraction and retention of one or more cards from the card management system. A management system for cards in accordance with a preferred embodiment of the present invention comprises a housing which contains a stack of cards, such as credit cards and the like with at least one card opening for locating and removing cards by rotating a spring-loaded thumb wheel.

When rotational pressure is applied to the spring-loaded thumb wheel, the thumb wheel rotates and the rotational movement of the thumb wheel is translated into a linear movement by a series of curved slots and pins, causing a card carrier to partially extend one or more cards through a card opening in the housing. With the cards now being partially exposed, one or more of the cards can be selected. When the pressure on the thumb wheel is released, the card carrier retracts back into the housing under the force of the spring tension.

BRIEF DESCRIPTION OF THE DRAWINGS

The various preferred embodiments of the present invention will hereinafter be described in conjunction with the appended drawings, wherein like designations denote like elements, and.

DETAILED DESCRIPTION OF THE PREFERRED EMBODIMENTS

The embodiments of the invention described herein are not intended to be exhaustive or to limit the invention to precise forms disclosed. Rather, the embodiments selected for description have been chosen to enable one skilled in the art to practice the invention.

Generally, a management system for cards in accordance with a preferred embodiment of the present invention comprises a housing which tightly fits around a stack of cards, such as credit cards and the like with at least one card opening for locating and removing cards.

The housing of the card management system comprising a spring-loaded thumb wheel that rotates when pressure is applied to the thumb wheel. With pressure applied, the thumb wheel is rotated and the rotational movement of the wheel is translated into a linear movement by a series of curved slots and pins, thereby causing a stepped card carrier to partially extend one or more cards through the card opening. With the card or cards now being partially exposed, one or more of the cards can be selected for use. When the pressure on the thumb wheel is released, the spring-loaded pressure applied to the card ejector moves the card carrier retracts back into the housing.

Figure 1:
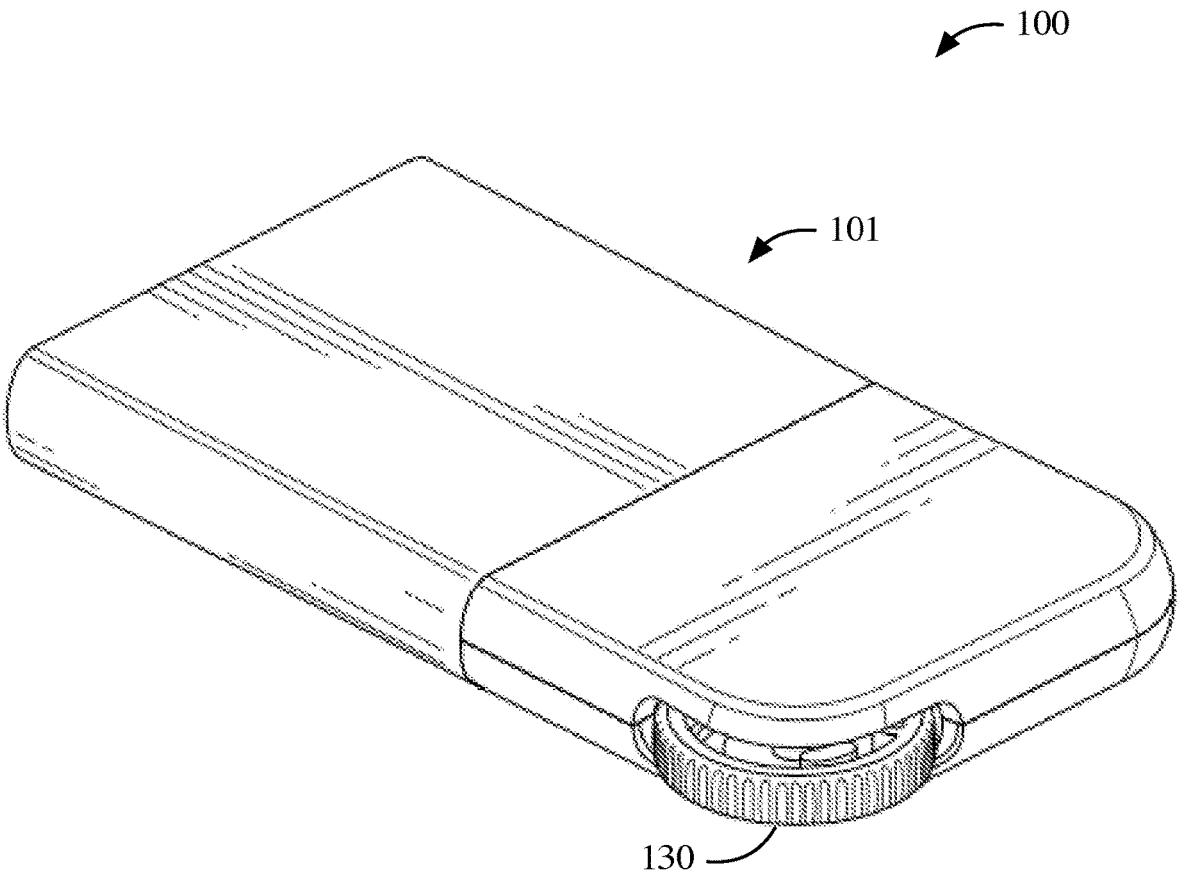
FIG. 1 is a perspective view of a card management system in accordance with a preferred exemplary embodiment of the present invention.

Referring now to FIG. 1, a card management system 100 in accordance with a preferred exemplary embodiment of the present invention is depicted. Card management system 100 comprises at least a housing 101 and a thumb wheel 130 that protrudes at least partially outside of the housing. The rotational operation of thumb wheel 130 creates a linear movement that will allow the user of card management system 100 to selectively extend or retract one or more cards into or out of housing 101. The rotational movement of thumb wheel 130 is translated into a linear movement by using a spring-loaded eccentric cam assembly (not shown this FIG.).

Figure 2:
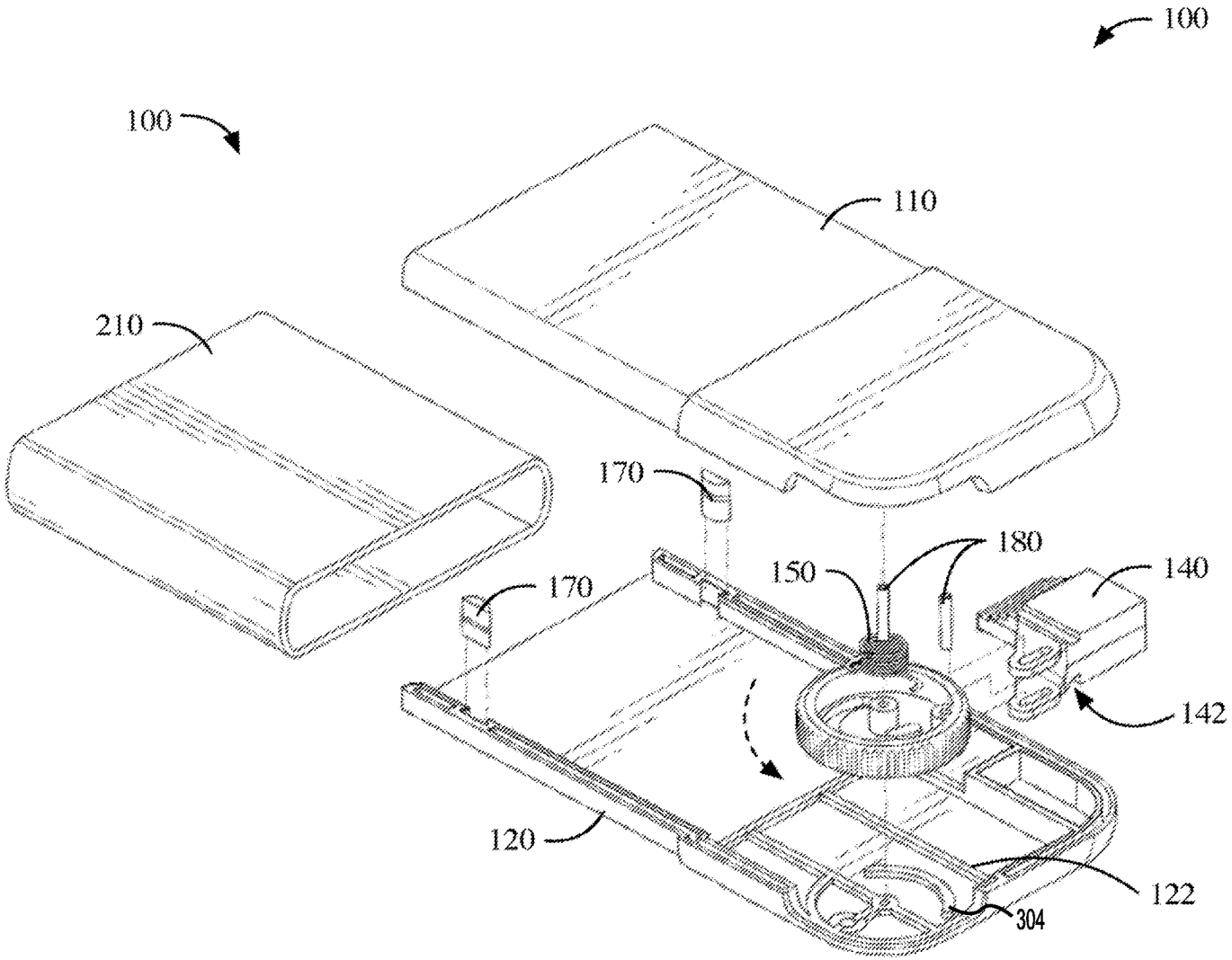
FIG. 2 is an exploded isometric view of a card management system in accordance with a preferred exemplary embodiment of the present invention.

Referring now to FIG. 2, an exploded view of card management system 100 from FIG. 1 in accordance with a preferred exemplary embodiment of the present invention is depicted. As shown in FIG. 2, card management system 100 most preferably comprises: a clam shell top half 110; a clam shell bottom half 120; thumb wheel 130; a stepped card carrier 140; a pair of cushioned inserts 170; a pair of pins 180; and a sleeve 210.

Clam shell top half 110 and clam shell bottom half 120 are most preferably manufactured from a durable material including plastics as well as light weight metals such as machined aluminum. Clam shell top half 110 and clam shell bottom half 120 are designed to fit snugly together, with the two pieces creating a single body where one end of the body comprises an opening sufficient to receive a plurality of credit cards or similar sized objects. Clam shell top half 110 and clam shell bottom half 120 are configured with a plurality of apertures, used to mount thumb wheel 130 in place and to provide the function of an eccentric cam during operation.

Thumb wheel 130 is positioned between clam shell top half 110 and clam shell bottom half 120 and mounted in place with a pin 180 so as to be rotatably mounted in position. Thumb wheel 130 is configured with a plurality of posts and apertures, used in mounting thumb wheel 130 in place and to provide the function of an eccentric cam during operation. In the most preferred embodiments of the present invention, at least a portion of thumb wheel 130 extends through an aperture formed in the single body created by the joining of clam shell top half 110 and clam shell bottom half 120. This allows thumb wheel 130 to be rotated by the user.

Stepped card carrier 140 is used to support a plurality of credits cards in a spaced apart fashion so that when thumb wheel 130 is activated by a force of rotation applied by a user, stepped card carrier 140 will move towards the top of the single body created by the joining of clam shell top half 110 and clam shell bottom half 120. With stepped card carrier 140 extending at least partially through the aperture formed in the single body created by the joining of clam shell top half 110 and clam shell bottom half 120. When the force of rotation applied to thumb wheel 130 by the user is released, stepped card carrier 140 will return into the interior of the single body created by the joining of clam shell top half 110 and clam shell bottom half 120. Slot 142 is provided to engage rail 122 to constrain the movement of stepped card carrier 140 in a substantially linear direction, thereby reducing the propensity for binding within clam shell top half 110 and clam shell bottom half 120.

Spring 150 is used to provide tension on thumb wheel 130. During normal operation, spring 150 is biased so as to provide tension on thumb wheel 130, which in turn will hold stepped card carrier 140 in place inside of the interior of the single body formed by clam shell top half 110 and clam shell bottom half 120.

Cushioned inserts 170 are most preferably manufactured from a durable yet resilient material so as to provide some level of friction on the sides of the credit cards that are inserted into card management system 100. Cushioned inserts 170 are inserted into openings in the sidewalls of clam shell top half 110 and clam shell bottom half 120, thereby providing an amount of friction necessary to prevent the credit cards from inadvertently sliding out of card management system 100. The amount of friction is minimal enough so as not to prevent free and easy movement of stepped card carrier 140 as it moves into and out of card management system 100.

In at least one preferred embodiment of the present invention, sleeve 210 is a piece of leather, plastic, or other material that slips over clam shell top half 110 and clam shell bottom half 120, holding clam shell top half 110 and clam shell bottom half 120 together. Those skilled in the art will recognize that there are a number of manufacturing options for card management system 100, including 2-piece designs where sleeve 210 is not used. However, for manufacturing and customization, the use of sleeve 210 provides significant benefits.

For example, sleeve 210 could be manufactured from a wide variety of materials, including leather or plastic. Branding and advertising, including specialty advertising could be included on sleeve 210. This allows a manufacturer to produce a large quantity of identical card management systems 100 and then customizing a subset of card management systems 100 according the wants and needs of wholesalers, distributors, end users, etc.

In operation, a user will manipulate thumb wheel 130 so as to cause thumb wheel 130 to rotate. As thumb wheel 130 rotates, pins 180 move in an eccentric fashion by virtue of the lands and grooves in clam shell top half 110 and clam shell bottom half 120, translating the rotational movement of thumbwheel 130 into a linear motion for stepped card carrier 140, thereby moving stepped card carrier 140 in and out of card management systems 100.

Figure 3:
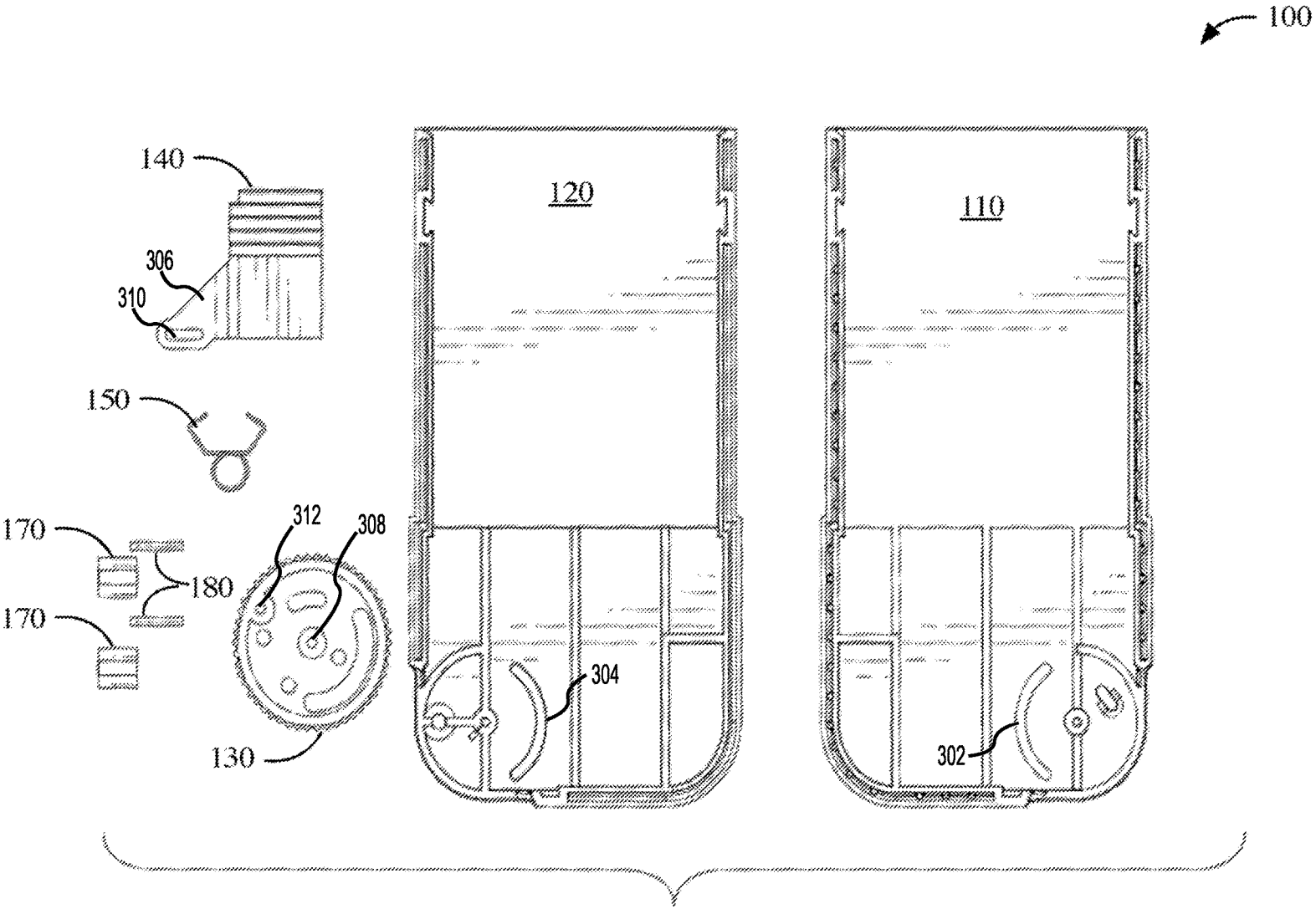
FIG. 3 is a disassembled card management system displaying the various components of a card management system in accordance with a preferred exemplary embodiment of the present invention.

Referring now to FIG. 3, a top and bottom view of the various components of card management systems 100 is depicted. As shown in FIG. 3, clam shell top half 110, clam shell bottom half 120, thumb wheel 130, stepped card carrier 140, cushioned inserts 170 pins 180 and, sleeve 210 are all used to card management systems 100. In various embodiments and with combined reference to FIGS. 3 and 4, a spring-loaded eccentric cam assembly may comprise spring 150, pins 180, thumb wheel 130, upper cam track 302, lower cam track 304, and cam follower 306. In various embodiments, the cam follower 306 may be coupled to the stepped carrier 140 and/or may be monolithic with the stepped card carrier 140. A pin 180 may be inserted through cam pin bore 312 which is located at proximate the circumferential edge of the thumb wheel (i.e., the cam pin). When enclosed by the clam shell top half 110 and clam shell bottom half 120, the distal ends of the pin 180 rest within and are respectively constrained by the upper and lower cam tracks (302, 304). In this regard, in response to rotation of the thumb wheel 130 about the center pin bore 308, the cam pin traverses an arcuate path described by the upper and lower cam tracks (302, 304). In various embodiments, the camp pin may be coupled to the cam follower 306 by insertion through the cam pin guide aperture 310. The cam pin is free to traverse linearly within the cam pin guide aperture 310 but otherwise constrained. Thus configured, as the cam pin traverses within the upper and lower cam tracks (302, 304) in response to rotation of the thumb wheel 130, the arcuate motion of the cam pin is translated into a linear motion of the cam follower 306 and thereby a linear motion of the stepped card carrier 140 along rail 122. In various embodiments, the spring 150 is coupled to the thumb wheel 130 such that it generates a return force in response to rotation of the thumb wheel 130. In this regard, the return force will tend to rotate the thumb wheel 130 opposite the driven direction to translate the cam pin within the cam tracks (302, 304) and thereby retract the stepped card carrier 140 and the eccentric cam assembly may thus be spring loaded.

Figure 4:
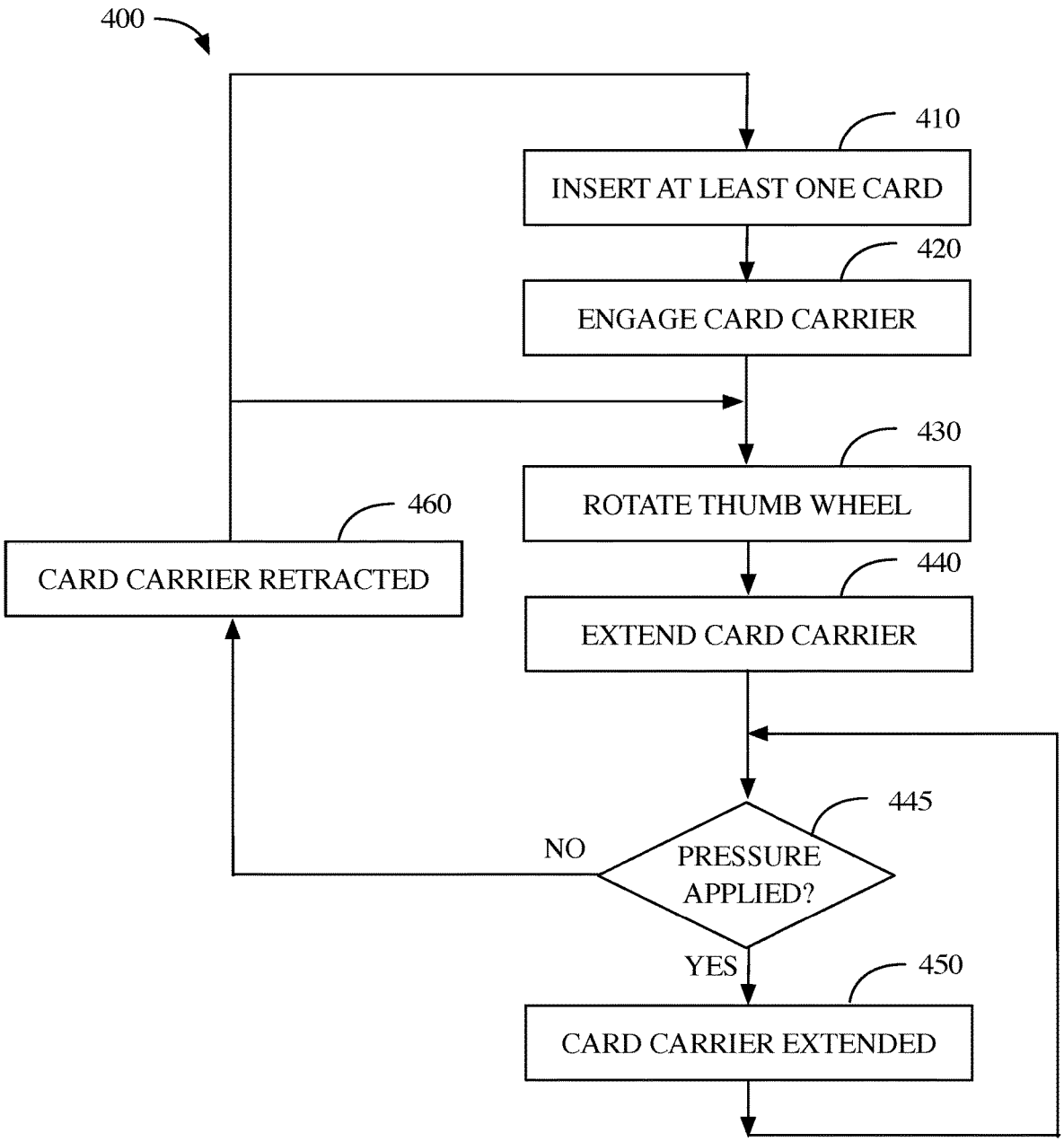
FIG. 4 depicts a method of using a card management system in accordance with a preferred exemplary embodiment of the present invention.

Referring now to FIG. 4, a method 400 for managing cards in accordance with a preferred exemplary embodiment of the present invention is depicted. As shown in FIG. 4, a user can insert at least one card into card management systems 100 (step 410) where the bottom edge of the at least one card will contact the surface of stepped card carrier 140 and be held in place by cushioned inserts 170 (step 420). With the at least one card in position, the user can apply rotational force to thumb wheel 130 (step 430), thereby causing stepped card carrier 140 to exit the body of one card into card management systems 100 (step 440).

So long as rotational force is applied to thumbwheel 130 (step 445="YES") then stepped card carrier 140 will be extended (step 450). However, once rotational force is no applied to thumbwheel 130 (step 445="NO") then stepped card carrier 140 will be retracted (step 460). As shown in FIG. 4, these steps may be executed in any number of variations to load cards into and remove cards from card management systems 100.

In closing, it is to be understood that although aspects of the present specification are highlighted by referring to one or more specific embodiments, those skilled in the art will readily appreciate that these disclosed embodiments are only illustrative of the principles of the subject matter disclosed herein. Therefore, it should be understood that the disclosed subject matter is in no way limited to a particular methodology, protocol, and/or material, etc., described herein. As such, various modifications or changes to or alternative configurations of the disclosed subject matter can be made in accordance with the teachings herein without departing from the spirit of the present specification.

Lastly, the terminology used herein is for the purpose of describing particular embodiments only, and is not intended to limit the scope of the present disclosure, which is defined solely by the claims. Accordingly, embodiments of the present disclosure are not limited to those precisely as shown and described.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should at least be construed in light of the number of reported significant digits and by applying ordinary rounding techniques.

Notwithstanding that the numerical ranges and values setting forth the broad scope of the disclosure are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

The terms "a," "an," "the" and similar referents used in the context of describing the disclosed embodiments (especially in the context of the following claims) are to be construed to cover both the singular and the plural, unless otherwise indicated herein or clearly contradicted by context. All methods described herein can be performed in any suitable order unless otherwise indicated herein or otherwise clearly contradicted by context. The use of any and all examples, or exemplary language (e.g., "such as") provided herein is intended merely to better illuminate the present disclosure and does not pose a limitation on the scope of the embodiments otherwise claimed. No language in the present specification should be construed as indicating any non-claimed element essential to the practice of the disclosed embodiments.

The invention claimed is:

1. A card management system comprising:

a housing;

at least one card being contained within the housing;

a stepped card carrier contained within the housing, the stepped card carrier contacting the at least one card contained within the housing;

a spring-loaded thumb wheel coupled to the stepped card carrier and being at least partially contained within the housing; and wherein the card carrier moves in a linear fashion from a first position to a second position in response to a rotational force applied to the spring-loaded thumb wheel.

2. The card management system of claim 1 wherein the housing further comprises:

a top half; and a bottom half, the bottom half comprising at least one rail; and wherein the stepped card carrier comprises at least one slot, the at least one rail engaging the at least one slot, thereby constraining the movement of the stepped card carrier.

3. The card management system of claim 1 wherein the at least one card comprises a plurality of cards.

4. The card management system of claim 1, further comprising an eccentric cam assembly including a cam pin connecting the spring-loaded thumb wheel and the stepped card carrier, whereby the stepped card carrier moves in a linear fashion from the first position to the second position in response to the rotational force applied to the spring-loaded thumb wheel.

5. The card management system of claim 4, further comprising a card opening in the housing, wherein the card carrier moves in a linear fashion from the first position inside the housing through the opening to the second position at least partially exterior to the housing in response to the rotational force applied to the spring-loaded thumb wheel.

6. A card management system comprising:

a housing, the housing comprising a top half, a bottom half, and a card opening;

at least one card being contained within the housing;

at least one cushioned insert contained in the bottom half, the at least one cushioned insert frictionally contacting the at least one card, thereby restricting movement of the at least one card;

a stepped card carrier contained within the housing, the stepped card carrier comprising a plurality of graduated steps, wherein at least one of the plurality of graduated steps is contacting the at least one card contained within the housing;

a thumb wheel being at least partially contained within the housing;

an eccentric cam assembly including a cam pin connecting the thumb wheel and the stepped card carrier; and wherein the card carrier moves in a linear fashion from a first position inside the housing through the opening to a second position at least partially exterior to the housing in response to a rotational force applied to the thumb wheel.

7. A method of storing and retaining credit cards, the method comprising the steps of:

inserting at least one card into a card management system, the card management system comprising:

a housing;

at least one card opening in the housing;

a stepped card carrier contained within the housing, the stepped card carrier contacting the at least one card contained within the housing; and a thumb wheel coupled to the stepped card carrier and being at least partially contained within the housing; and wherein the card carrier moves in a linear fashion from a first position inside the housing to a second position through the card opening and at least partially exterior to the housing in response to a rotational force applied to the thumb wheel.

8. The method of claim 7, further comprising the step of rotating the thumb wheel, thereby engaging an eccentric cam assembly and translating a rotational movement into a linear movement to the stepped card carrier into or out of the housing.

9. The method of claim 7, wherein the housing comprises: a top half and a bottom half, the bottom half comprising at least one rail; and wherein the stepped card carrier further comprises at least one slot, the at least one rail engaging the at least one slot, thereby constraining the movement of the stepped card carrier.

10. The method of claim 7 further comprising the step of rotating the thumb wheel to extend the stepped card carrier to an extended position where at least a portion of the stepped card carrier is visible outside the housing from a retracted position where the stepped card carrier is contained completely within the housing.

11. The method of claim 7 further comprising the step of rotating the thumb wheel to retract the stepped card carrier to a retracted position where the stepped card carrier is contained completely within the housing from an extended position where at least a portion of the stepped card carrier is visible outside the housing.

* * * * *